United States Patent [19]

Karis et al.

[11] Patent Number: 4,457,657

[45] Date of Patent: Jul. 3, 1984

[54] INTEGRAL PAPER COLLECTION AND TRANSFER ASSEMBLY

[75] Inventors: Arthur T. Karis, Lenox; Peter J. Eberth, Tyringham, both of Mass.

[73] Assignee: Beloit Corporation, Beloit, Wis.

[21] Appl. No.: 285,482

[22] Filed: Jul. 21, 1981

[51] Int. Cl.[3] ..... B65H 31/30

[52] U.S. Cl. ..... 414/45; 198/809; 254/9 C; 254/122; 254/126; 414/43; 414/100; 414/903

[58] Field of Search ..... 414/45, 43, 98, 100, 414/903; 254/9 C, 122, 126; 198/809, 433, 457, 837, 839; 271/118, 184, 198, 225, 275

[56] References Cited

U.S. PATENT DOCUMENTS

| | | | |
|---|---|---|---|
| 2,560,797 | 7/1951 | Humphreys | 254/126 |
| 2,706,102 | 4/1955 | Cresci | 254/122 |
| 3,104,007 | 9/1963 | Swezey et al. | 198/809 |
| 3,379,320 | 4/1968 | Loach et al. | 414/903 X |
| 3,556,481 | 1/1971 | Mueller et al. | 254/122 |
| 3,621,971 | 11/1971 | Daniels, Sr. et al. | 198/433 |
| 3,822,777 | 7/1974 | Jepsen | 198/809 X |
| 3,892,168 | 7/1975 | Grobman | 414/100 X |
| 4,149,626 | 4/1979 | Holt | 198/809 X |
| 4,234,282 | 11/1980 | Lewallyn | 414/100 X |
| 4,256,222 | 3/1981 | Gunti | 198/457 |
| 4,273,234 | 6/1981 | Bourgeois | 198/482 X |
| 4,311,230 | 1/1982 | Crawford et al. | 198/457 |

FOREIGN PATENT DOCUMENTS

| | | | |
|---|---|---|---|
| 596458 | 4/1960 | Canada | 254/122 |
| 1175852 | 8/1964 | Fed. Rep. of Germany | 254/122 |
| 2240459 | 3/1973 | Fed. Rep. of Germany | 198/837 |

*Primary Examiner*—Robert J. Spar
*Assistant Examiner*—Janice Krizek
*Attorney, Agent, or Firm*—Hill, Van Santen, Steadman & Simpson

[57] ABSTRACT

A ream collection lift table and asssociated transfer conveyor system are contained in a unitary assembly which is mounted beneath a sheet discharge end of a sheeting machine. The lift table portion utilizes a scissors-elevating structure for reciprocating a sheet collection surface. The elevating structure includes criss-crossed, collapsible scissors arms, each provided with shaped profile surfaces for engagement with a laterally movable roller driven at constant speed, whereby the collection surface descends at varying rates. At a lowermost position, the collection surface deposits a collected ream onto a laterally directed belt conveyor, positioned intermediately of the integral assembly. The belt conveyor deposits the collected ream onto the receiving surface of an orthogonally directed slat conveyor for transferring the ream to a cartoning station off to one side of the sheeting machine. The slat conveyor is formed with slat chains, the upper portion of which is movable between a lowered, slanted, ream-receiving and an elevated, level, ream-conveying position. Structure for positioning the upper portion of the slat chain includes a reciprocated chain guide member formed underneath with slanted profile surfaces which ride over ramped support walls.

26 Claims, 10 Drawing Figures

FIG. 6
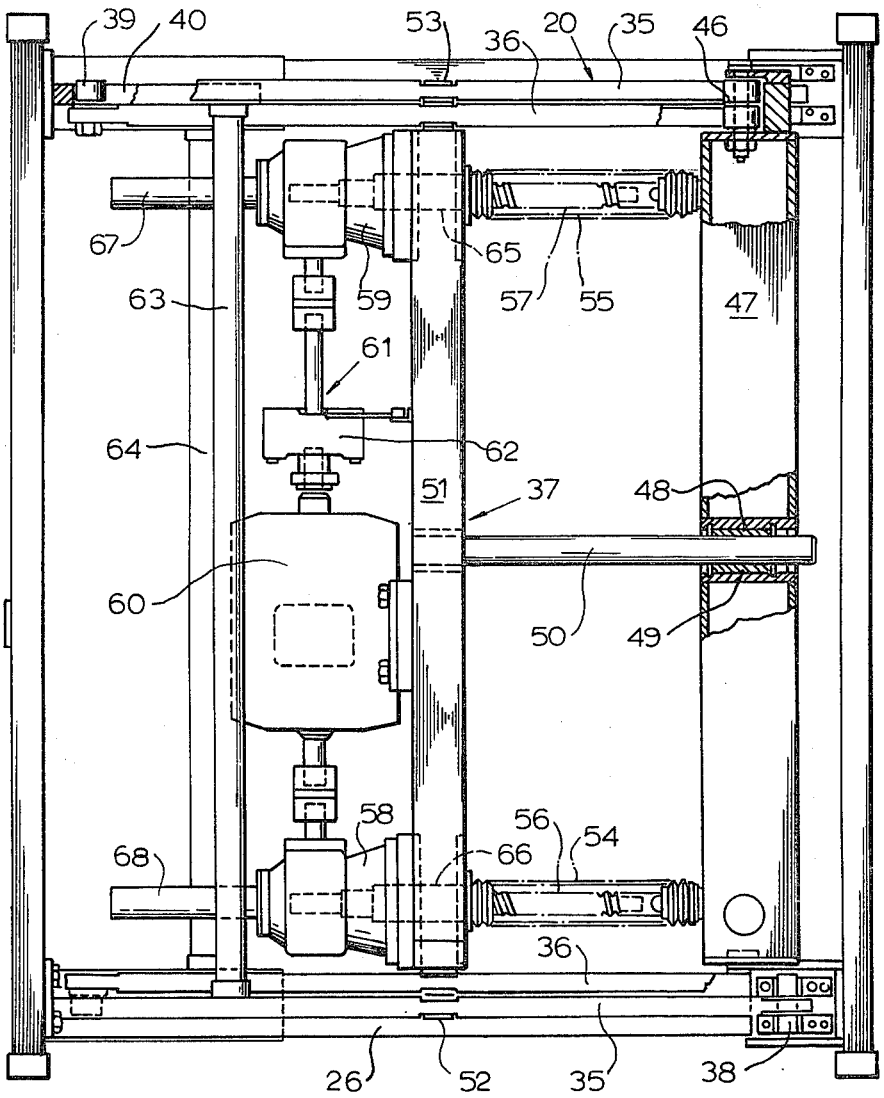
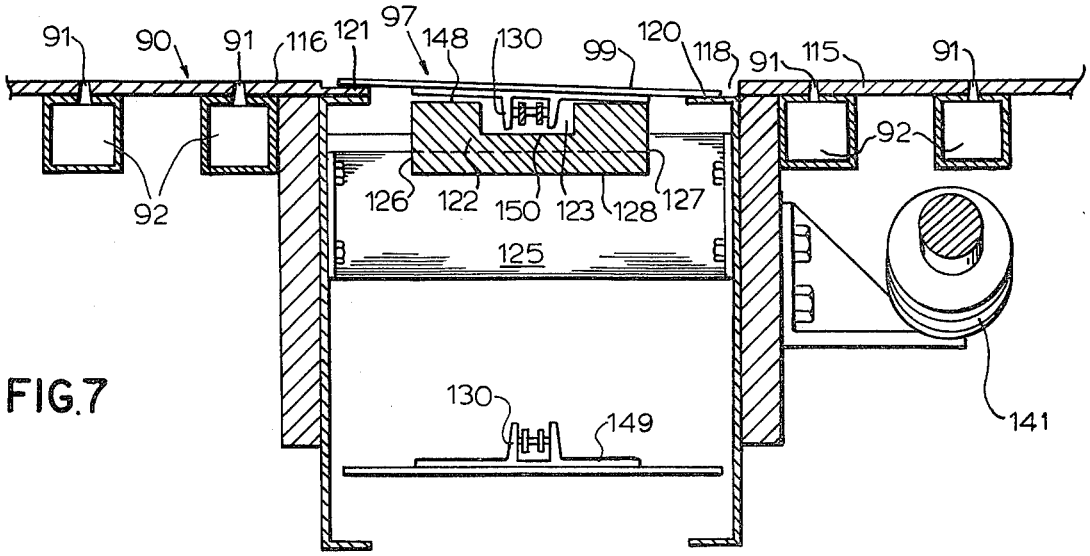
FIG. 7

INTEGRAL PAPER COLLECTION AND TRANSFER ASSEMBLY

BACKGROUND OF THE INVENTION

1. Field of the Invention

The present invention relates to the handling of sheet material and, more particularly, is directed to an integral ream collection table and transfer conveyor assembly for use with a continuous discharge sheeting machine.

2. The Prior Art

Sheeting machines are known in which cut sheets, particularly of paper, are advanced seriatim along a delivery conveyor system to a collector device where the sheets collect into piles. Typical collector units enable sheets to collect on a reciprocating platform which descends at the growing rate of the stack. In the case of sheet ream collection, after a predetermined pile has accumulated on the lift platform, the platform is lowered down to a level beneath a transfer belt conveyor system on which the ream pile is deposited. The transfer conveyor then transports the ream pile to a packaging or cartoning station.

Ream transfer conveyor systems are known which contain a transversely directed slat conveyor portion for conducting the ream pile off in a direction orthogonal to the initial transport flow path of the ream pile from the collector. In order to facilitate transfer of the ream pile from the initial laterally directed transfer conveyor portion onto the slat conveyor, the slat chain is initially tilted toward the lateral transfer conveyor portion in order to allow the ream to slide over it without catching on the adjacent side edge of the slats. After the ream has been deposited on the slat conveyor, the slats are leveled and raised relative to the slat conveyor top surface so as to conduct the ream in the orthogonal direction. One known arrangement for moving the slats of a slat conveyor between the slanted, receiving position and the upraised, leveled transport condition utilizes a pneumatically powered cam shaft device having corresponding cam surfaces for selectively engaging beneath the upper portion of the slat chain. One drawback with this arrangement, however, is that the positioning mechanism necessitates the use of heavy and expensive hardware, which is cumbersome and leads to high construction costs.

The present invention provides for a simplified and less expensive positioning mechanism for use with an orthogonally directed slat conveyor and, furthermore, concerns a ream lift table having criss-crossed, collapsible scissors arms and a constant speed drive arranged to vary the rate of descent of the lift table during ream collection operation.

SUMMARY OF THE INVENTION

A ream-collector lift table and adjacent transfer conveyor system are integrally joined in a unitary assembly which is mounted beneath a sheet discharge end of a sheeting machine. Suitable drive means enable the collection and transfer assembly to pass from a stowed, retracted position underneath the discharge end to an operational position in a collection area adjacent the discharge end. There, the ream lift table is positioned for ream collection operation within the collection area and the downstream discharge end of the transfer conveyor system is brought into alignment with a ream cartoning system positioned along one side of the sheeting machine.

The lift table portion of the assembly comprises a planar collecting surface which is reciprocated by scissors elevating means having criss-crossed, collapsible scissors arms. The scissors arms are provided with shaped profile surfaces for engagement with a laterally driven cam roller in such a way that the planar surface is lowered uniformly at a first rate as sheets accumulate thereon in a ream pile, and then, after the ream stack has formed and as further sheet flow onto the stack is interrupted, lowered at a second decelerating rate to deposit the ream pile onto the transport conveyor gradually without impact which would disturb the stack pile.

The transfer conveyor system has a laterally directed belt conveyor adjacent the lift table which receives the ream pile and transfers it to an orthogonally or transversely running slat conveyor. The slat conveyor has a generally planar top surface onto which the ream pile is deposited from the belt conveyor. The top surface is formed with transverse openings in which slat chains are mounted for endless loop rotation. The upwardly facing portions of the slat chains are moveable between a lowered, receiving position, wherein the slats are recessed in the top surface and tilted toward the belt conveyor to facilitate transfer of the ream pile over the slat chains and top surface, and an upraised, drive position, wherein the slats lie level and are elevated over the top surface for carrying the ream pile. In the lowered position, the slats rest freely on support ledges formed on opposed sides of the corresponding openings. Movement into the elevated position is afforded by a reciprocating chain guide means positioned beneath the upper portions of the slat chains. The chain guide means is formed underneath with slanted profile surfaces which ride over ramped support walls and above with surface means for engaging the slats and permittting their movement thereover.

BRIEF DESCRIPTION OF THE DRAWINGS

FIG. 6 is a cross-sectional view taken along the lines VI—VI of FIG. 3.

FIG. 7 is a fragmentary, cross-sectional view taken along the lines VII—VII of FIG. 2, wherein conveyor slats are in a lowered, receiving position.

DESCRIPTION OF THE PREFERRED EMBODIMENT

The preferred embodiment relates to the collection of batches or piles of paper sheets. However, other sheet material, such as board or cardboard, may also be handled by the present invention.

Figure 1:
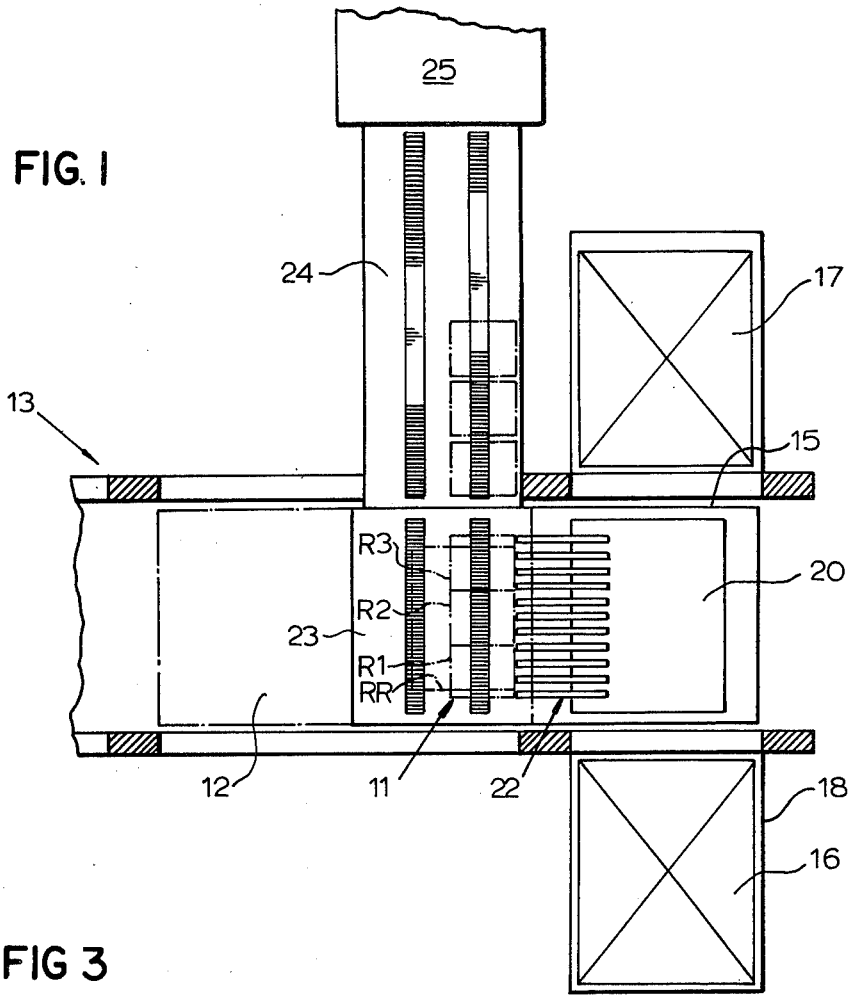
FIG. 1 is a schematic, broken-away plan view of a sheeting machine discharge end and collection area in which is mounted a unitary ream collector and transfer conveyor unit constructed in accordance with the present invention.
Figure 3:
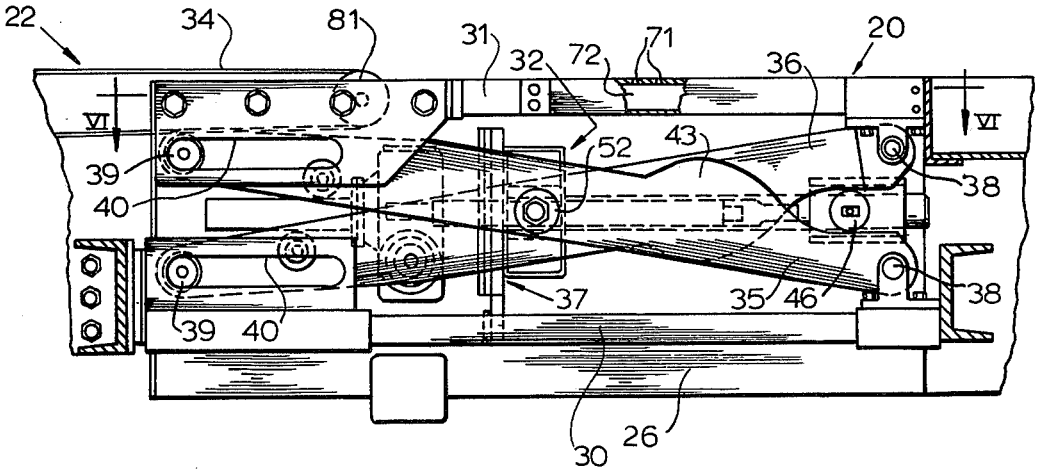
FIG. 3 is a partly schematic, cross-sectional side elevational view of the ream collection lift table portion of the integral ream collector and transfer conveyor unit in its fully lowered position.
Figure 2:
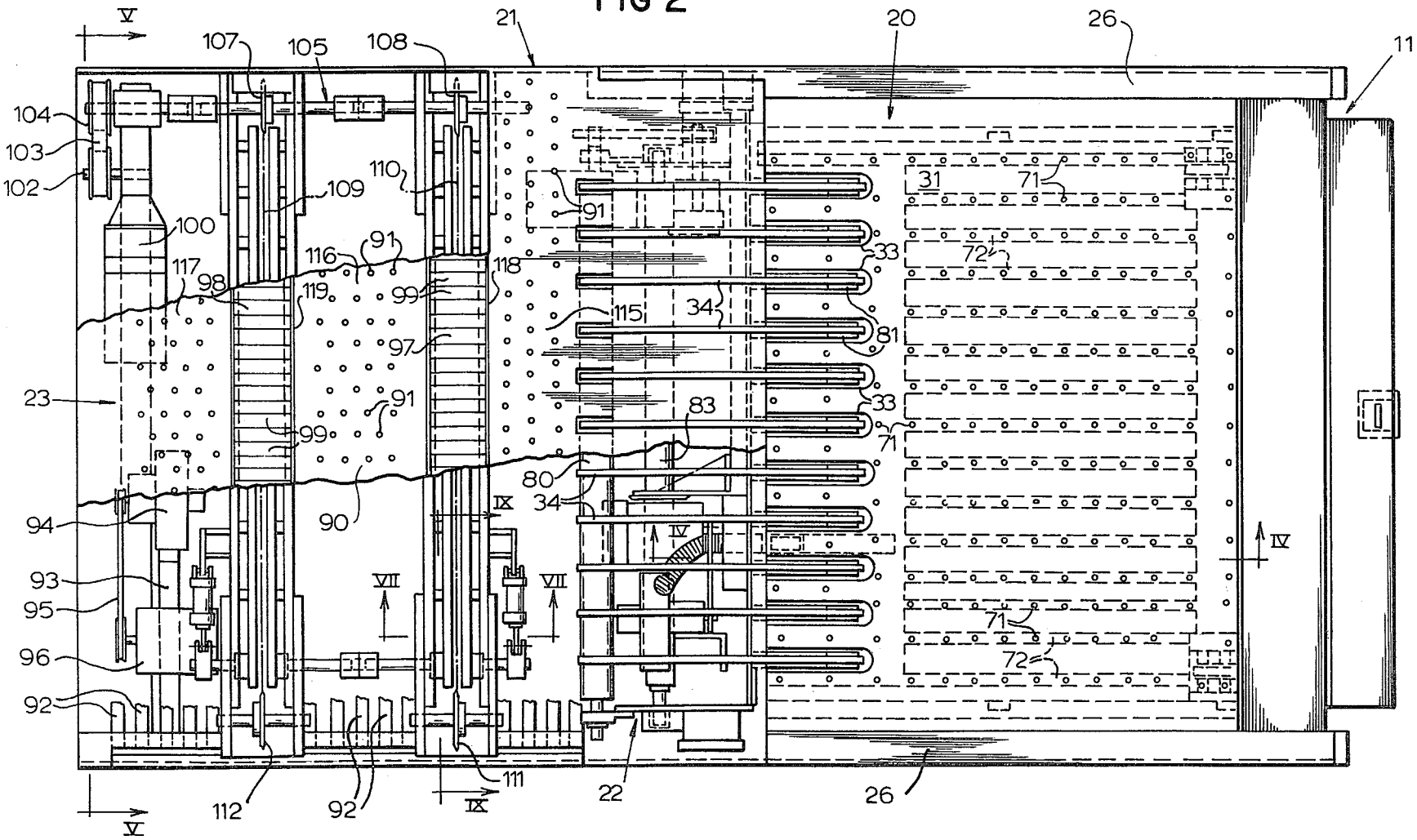
FIG. 2 is a partly schematic, broken-away view of the unitary ream collector and transfer conveyor unit constructed in accordance with the present invention.

FIGS. 1–2 illustrate a unitary ream collector and transfer conveyor assembly 11 constructed in accordance with the present invention. The assembly 11 is mounted underneath a sheet discharge end 12 of a sheeting machine 13. Paper sheets are cut from a continuous web in an upstream portion, not shown, of the sheeting machine 13 and passed seriatim along a conveyor mechanism to a kick-off assembly 14 (shown in FIG. 4) at the downstream free end of the sheet discharge end 12. Sheets pass through the kick-off assembly into a collection area 15 for piling. The sheeting machine 13 is adapted for continous collection of ream size piles of paper using the collection and transfer assembly 11 or skid load stacks.

Suitable drive means are provided for passing the collector and conveyor assembly 11 between a stowed, retracted position fully underneath the discharge end 12 of the sheeting machine and an operational position extending into the collection area 15 for ream collection operation. When the assembly 11 is in its retracted position, the sheeting machine 13 operates in a skid load collection mode, whereby skid lift tables 16 and 17 alternately shuttle into and out of the collection area 15 along a guidetrack pit 18. For skid loading, relatively high, heavy weight stacks of paper are collected onto pallets placed upon the skid lift tables. After a skid load stack has accumulated on one skid lift table in the collection 15, that table is conducted back out from the collection area to its corresponding opposed end of the pit 18 and the other skid table is concurrently conducted into the collection area for sheet accumulation to begin on an empty pallet. The skid load stack is removed by a fork lift truck and an empty pallet placed on the removed skid lift table for the cycle to repeat. This automatic switchover arrangement between ream collection and skid loading is fully disclosed in the commonly assigned, copending patent application Ser. No. 274,638, filed on behalf on Arthur Karis.

The unitary assembly 11 comprises a relatively small, high-speed ream lift table means 20 in a leading end portion, which extends into the collection area 15 during ream collection operation. Adjacent to the lift table 20 is a transfer conveyor system portion 21 for conducting collected ream piles away from the collection area 15 in a first direction and then in a second direction substantially orthogonal to the first direction. The transfer conveyor system 21 comprises a laterally directed belt conveyor 22 positioned intermediately in the assembly 11 and a transversely directed slat conveyor portion 23 positioned at the downstream end of the assembly. The belt conveyor 22 transports collected ream piles deposited thereon from the lift table 20 to the slat conveyor 23 which passes the ream pile from a discharge end thereof onto a further slat conveyor 24. The further slat conveyor 24 is positioned off to one side of the sheeter discharge end 12 and serves as the feed conveyor to a ream cartoning station 25. A generally rectangular framework 26 serves to support the ream collection lift table 20 and the transfer system 21 together as a unit for lateral movement between the retracted position beneath the discharge conveyor and the extended, operational position for ream collection operation.

With reference to FIGS. 2–4 and 6, the ream lift table 20 comprises a table base portion 30 secured to the assembly frame 26, a vertically movable table top portion 31 for carrying sheet reams, and a scissors arm elevating means 32 connected between the table base and top portions. The table top 31 is a generally planar surface formed with cut-away openings 33 along the trailing end thereof. The spaces 33 fit over the leading end of parallel spaced-apart belts 34 of the belt conveyor 22 when the table top is in a fully lowered position.

The scissors elevating means 32 comprises two sets of collapsible, criss-crossed scissors arms 35 and 36 positioned beneath opposed sides of the planar surface 31 and a drive arrangement 37 supported between the sets of scissors arms. Each scissor arm extends between the table top 31 and base 30 suitably pivotably connected at one end in a hinge mounting 38 and at the opposed end on a roller shaft 39 carried in a travel slot 40. The scissors arms 35 and 36 are formed with corresponding facing profile surfaces 41 and 42, respectively, which enable the table top 31 to descend at varying rates between its uppermost and lowermost positions. Each profile surface is similarly provided with a protruding hump portion 43 between generally level inner and outer end portions 44 and 45. The hump portion 43 has a relatively short, slanted inner surface profile 43A followed by a wide curve rounded tip porfile portion 43B leading to a relatively elongated, steeply sloping curved profile section 43C connecting into a gradually tapered end profile 43D leading to the level outer profile portion 45. The profile surface portions of the scissor arms engage with a cam roller means 46 which is mounted for lateral movement on the drive arrangement 37.

As shown in FIG. 6, the drive arrangement 37 comprises a movable transversely extending support member 47 for supporting the cam roller members 46 at opposed ends thereof. The member 47 is formed with a central opening 48 containing a sleeve portion 49 for receiving the free end of a guide bar 50 for back and forth motion through the opening 48. The guide bar 50 is fixedly connected to a transverse bracket 51 provided with opposed end pin means 52 and 53 which extend through the opposed sets of criss-cross scissors arms providing a center point about which the scissors arms 35 and 36 open and close. Extending between the elements 51 and 47 are tubular protective cover members 54 and 55 made of rubber positioned on either side of the guide bar 50. The cover members 54 and 55 are formed with corrugation so as to be collapsible as the support member 47 is moved relative to the bracket 51. A pair of threaded drive rods 56 and 57 are fixably connected to the support member 47 and extend laterally outward therefrom through suitable openings formed in the bracket 51 and into corresponding hollow extension housings 68 and 67. The collapsible coverings 54 and 55 extend concentrically about the rods 56 and 57. A reversible rotary electric step motor 60 is secured to the trailing side of the bracket 51 between the drive coupling housings 58 and 59. An output driveshaft means 61 transmits rotary output from the motor 60 to the drive coupling housings 58 and 59 for producing simultaneous rotation of ball nut members 66 and 65 mounted on the bracket 51 and receiving the threaded rods 56 and 57, respectively, in order to pass the drive rods and the support member 47 toward and away from the bracket. A suitable electric brake means 62 is provided along the driveshaft 61 for controlled locking and release of rotary drive output from the electric motor 60. Across from the bracket 51 on the other side of the driveshaft 61 there are provided first and second cross bar members 63 and 64 running transversely beneath the table top 31 to fixedly join together the corresponding scissors arms 35 and 36, respectively, of the two sets of scissors arms in order to facilitate even and simultaneous motion of the scissors arms beneath the table top 31.

Figure 4:
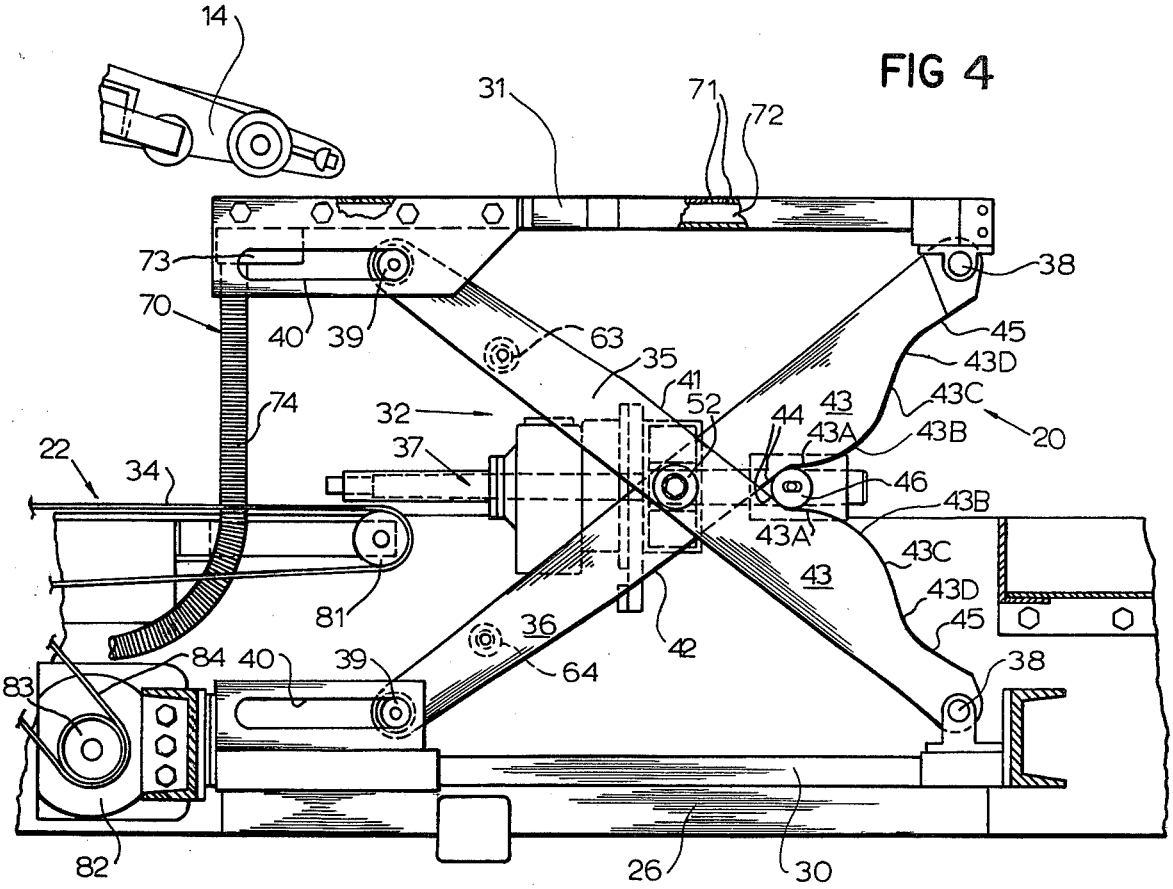
FIG. 4 is a cross-sectional view taken along the lines IV—IV of FIG. 2, wherein the ream collection lift table is in its fully extended raised position.

In sheet collection operation, the table top begins in an elevated state in the collection area 15 as shown in FIG. 4. To begin ream collection operation, the electric motor 60 is energized and the brake means 62 is released such that the ball nut members 66 and 65 pass over the rods 56 and 57, respectively, to pass the support member 47 away from the brackets, pushing the cam rollers 46 forwardly along the cooperating hump portions 43 of the scissor arms. The table top 31 begins a gradually accelerated descent as the cam rollers 46 pass along the rounded tip profile portions 43B. Cut sheets are discharged seriatim from the sheeter kick-off assembly and they begin to pile one on top of the other on the table top 31. Piling of the sheets issued from the discharge kick-off assembly on the table top 31 occurs mostly as the cam rollers 46 engage along the steeply curved profile faces 43C. At this stage, the table top is pulsed downward at a substantially uniform rate of descent in small step increments by virtue of a suitable signal control means for operating the step motor 60, such as one which utilizes an electric eye to sense the top of the sheet stack being formed to signal the motor to drop the table top an increment so as to be in suitable relation to the growing accumulation of sheets on the table top. When the cam rollers reach the end of the profile faces 43C, a ream stack will have collected on the table top and a suitable stack interrupted and divider means is inserted into the collection area 15 above the table top 31 to receive further accumulations of sheets from the sheeting machine. One such interrupted and divider device usable with the instant lift table operation is disclosed in the commonly assigned, copending U.S. Ser. No. 162,136, filed June 23, 1980, on behalf of Arthur Karis, now U.S. Pat. No. 4,359,218.

With sheets continuing to accumulate separately supported on the interrupter and divider means over the lift table 20, the cam rollers 46 continue to pass further forwardly and ride along the tapered profile portions 43D of the scissors arms. At this stage lowering of the table top 31 continues at a decelerating rate of descent until the table top reaches its fully lowered ream discharge position shown in FIG. 3. At this point, the table top 31 lies level beneath the upper surfaces of the belts 34 and a substantial portion of the ream pile rests upon spaced-apart belts 34 of the belt conveyor 22. The belt conveyor is activated to carry the ream pile laterally backward from the lift table 20. The gradual deceleration of the table top 31 as the collected ream pile is being passed to the belt conveyor 22 allows the ream to come to rest at its discharge point without a hard impact which might jostle the pile. The outer level profile portion 45 serves to permit overtravel for the cam rollers 46 during the descent operation.

Air pressure assist means 70 are provided in conjunction with the table top 31 to facilitate transfer of the ream pile from the table top onto the conveyor belts 34. The air pressure assist means include a series of air jet outlets 71 facing upward through the upper surface of the table top. The air jets 71 communicate with a series of air flow ducts 72 running through the table top surface. These flow ducts communicate with a supply manifold 73 located beneath the trailing edge of the table top 31 and connected with a source of pressurized air through a flexible, elongated hose 74. The flow of air through the air assist jets 71 commences when the table top 31 is in its lowered position and serves to buoy the ream pile against the weight of the sheets so that the conveyor belts 34 may readily conduct the ream pile from the lift table in a first direction away from the collection area 15.

After the ream pile has left the table top 31, the drive output of the electric motor 60 is again reversed, such that the table top 31 is elevated into its sheet receiving position in th collection area 15. The ascent begins with the cam rollers 46 being passed along the tapered profile portions 43D which permits a smooth gradual acceleration whereby initial load increases on the drive motor 60 and associated gearing are gradual for improved mechanical durability of the drive arrangement 37. As the cam rollers 46 reach the rounded tip profile portion 43B, a smooth deceleration of the rate of ascent of the table top 31 occurs during which the interrupter and divider means are withdrawn and the accumulated sheet pile is deposited on the table top 31. The slanted inner profile surfaces 43A serve to permit overtravel at the end of the upward stroke of the table top 31. Sheets are once again conducted for piling from the kick-off assembly onto the table top and the ream collection cycle repeats.

The collected ream pile is passed along the lateral belt conveyor 22 for deposit onto the transversely directed slat conveyor 23. The conveyor belts 34 are looped around a common drive roll 80 and corresponding, individual turnaround end rolls 81 which extend into the spaces 33 of the table top 31 of the lift table means. A suitable drive motor 82, shown in FIG. 4, is provided with a rotary driveshaft 83 which transmits rotary movement through a belt drive coupling 84 to the common drive roll 80 for operation of the belt conveyor 22. The rearward, discharge end of the conveyor belts 34 face a generally planar top surface 90 and deposit the ream pile thereon for transport by the slat conveyor 23.

Figure 5:
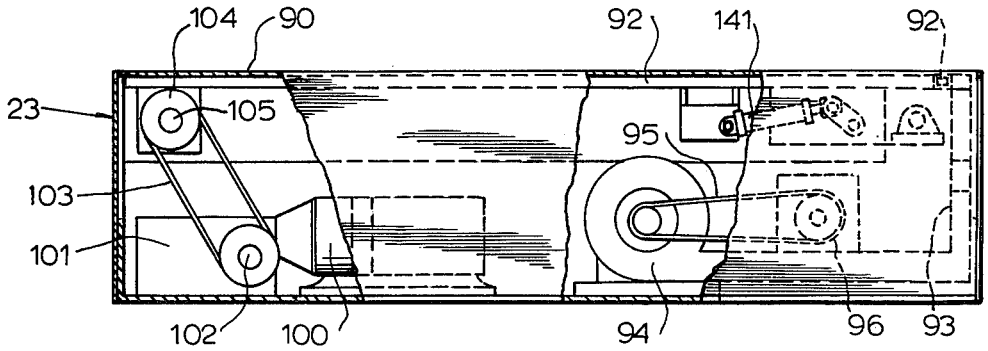
FIG. 5 is a partly schematic, cross-sectional view taken along the lines V—V of FIG. 2.

In order to facilitate transfer of the ream pile from the belt conveyor 22 onto the receiving surface 90, as well as to assist transport of the ream pile over the surface 90 during operation of the slat conveyor, further air pressure assist means, similar to that which is provided in the table top 31 of the lift table means 20, are arranged in the slat conveyor 21. The further air assist means include air jet openings 91 extending through the receiving surface 90 connected to air flow ducts 92 mounted against the undersurface of the receiving surface 90. As shown in FIGS. 2 and 5, the air flow ducts are connected to a common supply pipe 93, which extends from the discharge outlet of a rotary air blower 94, suitably driven via a drive transmission belt 95 from the output of a rotary motor 96.

The slat conveyor 23 is provided with two laterally spaced slat chains 97 and 98, each containing a closely packed series of relatively flat, individual slats 99 in the form of an endless loop running transversely across the receiving surface 90. The slat chains 97 and 98 are operated simultaneously and may either both serve to conduct a ream pile in a relatively orthorgonal direction over the receiving surface 90 in the case of relatively large sheets or the forwardmost slat chain 97 may operate alone, in the case of relatively small sheet sizes, to transfer a ream pile.

With reference to FIGS. 2 and 5, the slat chains are driven via a rotary motor 100 having an output into a drive coupling housing 101 provided with a rotary output driveshaft 102. A drive transmission belt 103 serves to connect the rotary driveshaft 102 with a drive roll member 104 connected to a laterally extending driveshaft means 105. Mounted along the driveshaft 105 are driven turnaround sprocket wheels 107 and 108 which suitably engage with endless drive chains 109 and 110 upon which the slats of the respective slat chains 98 and 97 are mounted such that the planar surface of each slat overhangs opposed sides of the corresponding drive chain. Connector bracket members 130, shown in FIGS. 7 and 8, serve to attach the slats 99 to the drive chains. At the opposed ends of the slat chains 97 and 98, free-running turnaround sprocket wheels 111 and 112 are respectively provided to support the slat chains in conjunction with the drive sprockets 108 and 107, respectively, for endless rotary movement.

The receiving surface 90 is horizontal and arranged in a series of table surface portions 115, 116, and 117. The slat conveyor chains 97 and 98 run along transversely directed openings 118 and 119, respectively, formed in the upper receiving surface 90. As a ream pile is deposited onto the receiving surface 90, the upper portions of the slat chains 97 and 98 are positioned so as to be tilted across the corresponding spaces 118 and 119 to an angle leading toward the delivery end of the conveyor belts 34. In this manner, the leading edges of the ream pile are passed smoothly across the receiving surface 90 without catching on slat edges or butting against the forward edges of a next adjacent platform step. After the ream pile has been fully deposited onto the receiving surface 90 of the slat conveyor 21, the upper portions of the slat chains are elevated above the surface 90 and the slat chains are operated to conduct the ream pile in a second orthogonal direction off to the side of the sheeting machine 13 for deposit onto the slat conveyor chains of the feed conveyor 24 leading to the ream cartoning station 25.

Figure 8:
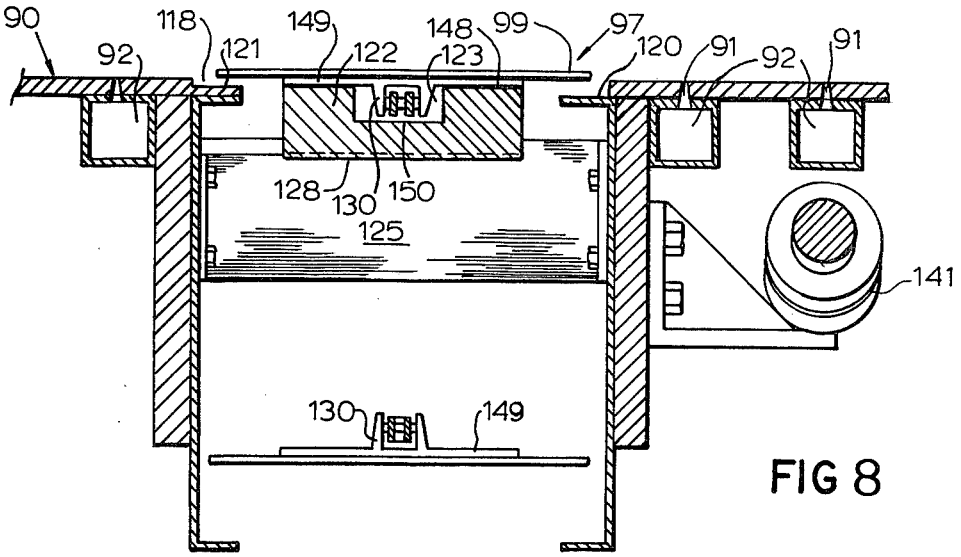
FIG. 8 is a cross-sectional view similar to FIG. 7, wherein conveyor slats are in a raised, operational position.
Figure 9:
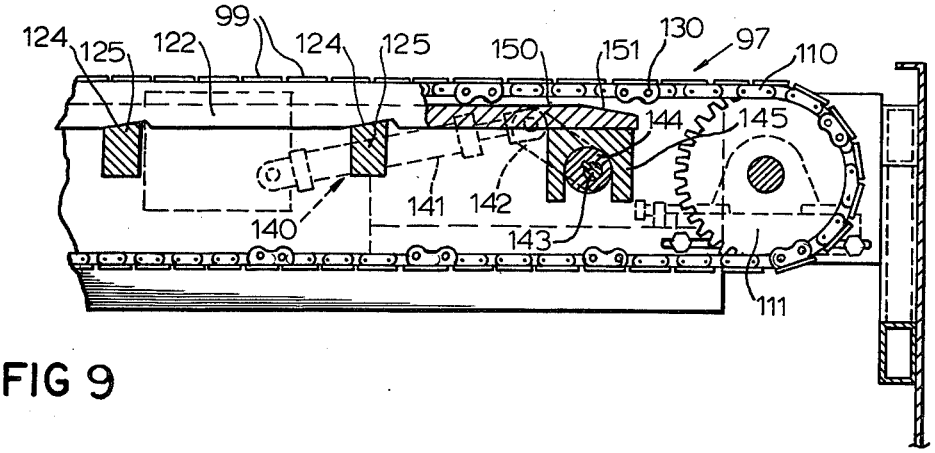
FIG. 9 is a fragmentary, cross-sectional view taken along the lines IX—IX of FIG. 2.

FIGS. 7–10 illustrate means for moving the upper surfaces of the slat chains 97 and 98 between their slanted receiving positions and elevated, running positions. With reference to FIGS. 7 and 9, the slats 99 of the upper portion of the slat chain 97 are shown in their slanted, receiving position. Since the structure for the other slat chain 98 is duplicative, only one slat chain need be described. The slats 99 are relatively recessed beneath the top surface 90. Opposed side ledge surfaces 120 and 121 extend outward from the adjacent side surfaces of the platform steps 115 and 116, respectively, which face across from the platform opening 118, to support corresponding opposed side surfaces of the slats 99. The forward ledge surface 120 is formed with a deeper relief than the rear ledge surface 121 such that the ledge surface 120 is relatively lower than the ledge 121 and the slats 99 are slanted at an angle leaning toward the conveyor belts 34. In this manner, the upraised ends of the slats 99 are nearly contiguous with the upper edge of the following surface 116.

A longitudinally extending chain guide 122, preferably made of low-friction material, is positioned beneath the upper portion of the slat chain. The chain guide is formed with a central upper surface recess 123 through which the drive chain 110 passes during movement of the slat chain 97. The undersurface of the chain rests upon fixed wall members 125 for supporting the chain guide. The wall members 125 are bolted at opposed ends to support walls of the assembly frame 26 and extend laterally beneath the upper portion of the slat chain. Each of the wall members 125 has a cental recess area formed by opposed side surface portions 126 and 127 for supporting the chain guide against lateral movement and a ramped bottom surface 128 which engages with the corresponding profile surface 124 of the chain guide.

The chain guide 122 is supported for back and forth longitudinal movement beneath the upper portion of the slat chain 97. In the lowered, receiving position of the slats 99, the chain guide 122 is in a first, retracted position, shown in FIG. 9, wherein the ramped surfaces 128 of the support walls 125 engage against the relatively elevated, leading portions of the chain guide profile surfaces 124. In this position, the chain and slats are freely supported in the slanted, receiving position by means of the ledge surfaces 121 and 120. Back and forth movement of the chain guide 122 is afforded by a chain guide drive mechanism 140, which is positioned beneath the receiving surface 90 and comprises a pressurized air piston-cylinder device 141 for moving a pivot arm 142 keyed to a rotating cam shaft 143. The cam shaft 143 is supported for rotational movement beneath one end of the slat chains 97 and 98. Keyed to the cam shaft 143 substantially beneath the leading ends of each of the chain guides is an eccentric cam member 144 which is received in a cam follower block 145 connected to the corresponding chain guide.

Figure 10:
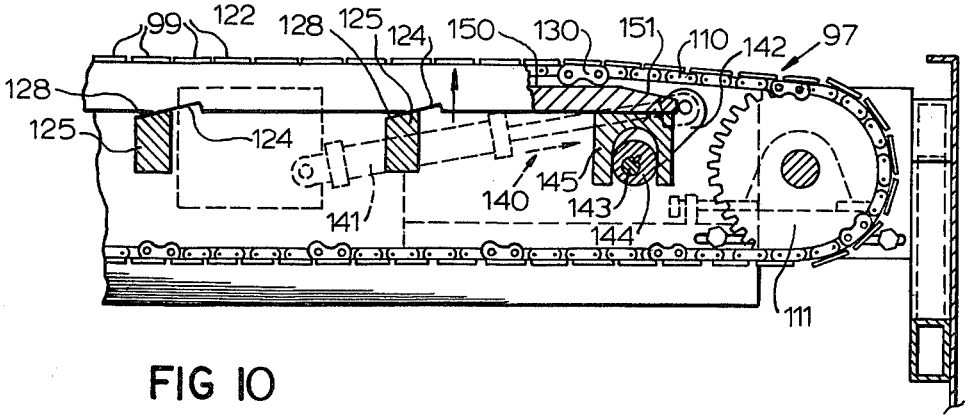
FIG. 10 is a cross-sectional view similar to FIG. 9, wherein the conveyor slats are in their raised, operational position.

The upper portions of the slat chains 97 and 98 are simultaneously elevated so that the chain slats 99 are in their upraised, transport position, as shown in FIGS. 8 and 10, via extension of the piston-cylinder device 141 causing an approximately 90° rotation of the pivot arm 142. This action draws the eccentric portion of the cam member 144 over the cam shaft 143, thereby drawing the cam follower 145 and, hence, the chain guide forwardly. With the chain guide moving forwardly, the profile surfaces 124 are drawn over the ramped surface 128 of the support walls 125 until the trailing, lower portions of the profile surfaces rest on the support walls. Accordingly, the chain guide is elevated. Upwardly facing side surface portions 148 formed on either side of the recess 123 engage against cooperating bearing surface means 149 formed underneath the overhanging surfaces of the slats 99. The drive chain 110 fits into the chain guide recess 123. The slats 99 are brought to a laterally level position over the receiving surface 90 and are thus in an operational position for transporting the ream pile in the orthogonal direction. The chain guide upper cavity 123 is formed with a bottom wall surface 150 having front and back end beveled portions 151 for receiving the slat 99 upon the chain guide support surfaces 148 during movement thereacross of the slat chain. To lower the slat chains 97 and 98 back to their receiving positions, shown in FIG. 7, the piston-cylinder device 141 retracts, bringing the eccentric portion of the cam 144 back over the cam shaft 143 such that the chain guide is pushed backward until the leading portions of the profile surfaces 124 again rest on the support walls 125.

With the slat chains 97 and 98 in their upraised, driving position, the deposited ream pile is passed off to the side beneath the sheeter discharge end and transferred to the feed slat conveyor 24 which carries the ream pile to the station 25 for cartoning. After the ream pile has been transferred onto the feed slat conveyor 24, the chain guides are lowered and the chain slats 99 are placed in their slanted, receiving position to receive a further collected ream pile passed from the belt conveyor 22 onto the receiving surface 90 of the slat conveyor 23.

The present invention may handle relatively small sheet sizes for which only the forward slat chain 97 may be necessary to handle transfer of the ream pile. A plurality of small-size sheet reams $R_1$, $R_2$, and $R_3$, as shown in FIG. 1, may be collected at one time in the collection area 15 and deposited from the lift table means 20 onto the belt conveyor 22 which then passes the piles $R_1$, $R_2$, and $R_3$ onto the slat conveyor 23. A relatively large-size sheet ream RR may also be handled, whereupon both slat chains 97 and 98 would handle transfer of the ream pile.

Although various minor modifications may be suggested by those versed in the art, it should be understood that we wish to embody within the scope of the patent warranted hereon all such modifications as reasonably and properly come within the scope of our contribution to the art.

We claim as our invention:

1. An improved slat conveyor assembly for receiving thereon a sheet pile from a first direction and transporting said sheet pile in a second direction substantially perpendicular to said first direction having a generally planar top surface onto which said sheet pile is deposited from said first direction, a longitudinal opening in said top surface running in said second direction, a slat chain mounted for endless loop rotation in said opening with an upper portion thereof facing upward from said opening, said slat chain including a drive chain and a seried of individual slats connected to said drive chain with planar surfaces overhanging opposed sides of said drive chain, the improvement comprising:

opposed ledge surfaces facing across said opening for supporting the slats in said upper portion of said slat chain along their planar surfaces in a receiving position substantially recessed in said top surface and tilted toward said first direction to facilitate receipt thereover of said sheet pile from said first direction, a guide member mounted for longitudinal back and forth movement beneath said upper portion of said slat chain and having an upper surface for engaging said upper portion for movement thereover and a lower profiled surface portion, a support surface means for engaging said profiled surface portion, and drive means for moving said guide member such that by movement one way slats in said upper portion are in their receiving position and by movement the opposite way said slats in said upper portion are in a transport position substantially elevated over said top surface with planar surfaces level to support said ream pile for transfer in said second direction.

2. The improvement of claim 1, wherein said guide member is made of low-friction plastic.

3. The improvement of claim 1, wherein said lower profiled surface portion is slanted upward in the direction of said movement one way.

4. The improvement of claim 3, wherein said support surface means is slanted upward in the direction of said movement one way.

5. The improvement of claim 1, wherein said guide member includes upwardly facing surface portions for supporting said slat planar surfaces for movement thereover in said transportposition.

6. The improvement of claim 5, wherein bearing surfaces are formed beneath said slat planar surfaces for engaging with said upwardly facing surface portions.

7. The improvement of claim 1, wherein said top surface is formed with a series of planar step portions extending upward in said first direction and substantially separated from one another by said opening.

8. The improvement of claim 7, wherein the upraised ends of said slats in said receiving position are substantially contiguous with an upper surface edge of the step portion adjacent thereto.

9. The improvement of claim 1, wherein said drive means comprises a pressure fluid piston-cylinder device, an eccentric cam mounted on a cam shaft rotatable by said piston-cylinder device, and a cam follower block connected to said guide member and cooperatively engaging with said eccentric cam.

10. The improvement of claim 1, wherein said top surface is formed with two parallel, spaced-apart longitudinal openings and two identically constructed slat chains which are mounted for simultaneous loop rotation and have upper portions mounted for simultaneous movement between receiving and transport positions.

11. The improvement of claim 10, wherein said top surface is formed with a series of planar step portions extending upward in said first direction and substantially separated from one another by said openings.

12. A unitary assembly for collecting a pile of sheets discharged seriatim into a collection area from a sheeting machine and transferring said pile away from said collection area in a first direction and then a second direction substantially orthogonal to said first direction comprising:

a framework for supporting a lift table means in said collection area and a transfer conveyor means adjacent to said lift table means extending from said collection area, said lift table means having a planar surface for receiving said sheets and elevating means mounted between said framework and planar surface for reciprocating said planar surface in said collection area between raised positions during which said pile is collected and a lowermost position for depositing said pile onto said transfer conveyor means, said transfer conveyor means having a belt conveyor means adjacent said lift table means for transporting said pile in said first direction and a slat conveyor means adjacent said belt conveyor for transporting said pile in said second direction, wherein said slat conveyor comprises:

a generally planar top surface, a longitudinal opening in said top surface running in said second direction, a slat chain means mounted for endless loop rotation in said opening with an upper portion thereof facing upward from said opening, including a drive chain and a series of individual slats connected to said drive chain with planar surfaces overhanging opposed sides of said drive chain, opposed ledge surfaces facing across said opening for supporting the slats in said upper portion of said slat chain along their planar surfaces in a receiving position substantially recessed in said top surface and tilted toward said first direction to facilitate receipt thereover of said sheet pile from said first direction, a guide member mounted for longitudinal back and forth movement beneath said upper portion of said slat chain and having an upper surface for engaging said upper portion for movement thereover and a lower profiled surface portion, a support surface means for engaging said profiled surface portion, and drive means for moving said guide member such that by movement one way said slats in said upper portion are in their respective position and by movement the opposite way said slats in said upper portion are in a transport position substantially elevated over said top surface with planar surfaces level to support said ream pile for transfer in said second direction.

13. The assembly of claim 12, wherein said pile is a ream-size stack.

14. The assembly of claim 12, wherein said planar surface includes air pressure means for assisting transfer of said pile to said belt conveyor.

15. The assembly of claim 12, wherein said elevating means comprises:

criss-crossed, collapsible scissors arms, each pivotably connected at respective opposed ends to said planar surface and said framework.

16. The assembly of claim 15, further comprising:

facing profile surfaces formed on each scissors arm having a protruding hump portion between generally level inner and outer end portions and a drive means having a cam roller means for engaging said facing profile surfaces and mounted for back and forth lateral movement along said hump and end portions.

17. The assembly of claim 16, wherein said hump portion comprises a tapered profile surface whereby descent of said planar surface is relatively slowed as said cam roller means passes along said tapered profile surface.

18. The assembly of claim 17, wherein said hump portion further contains a steeply sloping profile surface adjacent a tapered profile surface, whereby said planar surface descends at a substantially uniform first rate as said cam roller means passes along said sloping profile surface and at a relatively slowed second rate as said cam roller means passes along said tapered profile surface.

19. The assembly of claim 12, wherein said guide member is made of low-friction plastic.

20. The assembly of claim 12, wherein said lower profiled surface portion is slanted upward in the direction of said movement one way.

21. The assembly of claim 20, wherein said support surface means is slanted upward in the direction of said movement one way.

22. The assembly of claim 12, wherein said guide member includes upwardly facing surface portions for supporting said slat planar surfaces for movement thereover in said transport position.

23. The assembly of claim 22, wherein bearing surfaces are formed beneath said slat planar surfaces for engaging with said upwardly facing surface portions.

24. The assembly of claim 22, wherein said top surface contains two parallel, laterally spaced slat chain means of substantially identical construction for simultaneous operation thereof.

25. The apparatus of claim 24, wherein the upraised ends of said slats in said receiving position are substantially contiguous with an upper surface edge of the top surface adjacent thereto.

26. The apparatus of claim 12, wherein said top surface includes air pressure assist means.

* * * * *

UNITED STATES PATENT AND TRADEMARK OFFICE

CERTIFICATE OF CORRECTION

PATENT NO. : 4,457,657

DATED : July 3, 1984

INVENTOR(S) : Arthur T. Karis & Peter J. Eberth

It is certified that error appears in the above-identified patent and that said Letters Patent are hereby corrected as shown below:

Column 11, line 19, change "respective" to --receiving--.

Signed and Sealed this

*Nineteenth* Day of *February 1985*

[SEAL]

*Attest:*

DONALD J. QUIGG

*Attesting Officer* *Acting Commissioner of Patents and Trademarks*